US007784392B1

(12) United States Patent
Manney, III

(10) Patent No.: US 7,784,392 B1
(45) Date of Patent: Aug. 31, 2010

(54) HYDRAULIC LOCKING CYLINDER

(75) Inventor: Charles J. Manney, III, Hamburg, NY (US)

(73) Assignee: HDM Hydraulics, LLC, Tonawanda, NY (US)

( * ) Notice: Subject to any disclaimer, the term of this patent is extended or adjusted under 35 U.S.C. 154(b) by 902 days.

(21) Appl. No.: 11/546,790

(22) Filed: Oct. 12, 2006

(51) Int. Cl.
*F15B 15/00* (2006.01)
*F02B 61/00* (2006.01)

(52) U.S. Cl. ..... 91/422; 92/181 R

(58) Field of Classification Search ..... 91/401, 91/422; 92/181 R, 181 P, 183; 188/316
See application file for complete search history.

(56) References Cited

U.S. PATENT DOCUMENTS

| | | | | | |
|---|---|---|---|---|---|
| 1,652,033 | A | * | 12/1927 | Martyn | 92/181 R |
| 3,470,793 | A | | 10/1969 | Hanchen | |
| 3,483,952 | A | * | 12/1969 | Cardwell | 188/312 |
| 3,662,649 | A | | 5/1972 | Williams | |
| 3,799,032 | A | | 3/1974 | Honeycutt | |
| 4,524,676 | A | | 6/1985 | Rogers | |
| 4,557,290 | A | | 12/1985 | Chanal et al. | |
| 4,596,321 | A | * | 6/1986 | Harper et al. | 188/322.15 |
| 4,718,330 | A | * | 1/1988 | Mitton | 91/422 |
| 5,097,748 | A | | 3/1992 | Koch et al. | |
| 5,163,351 | A | | 11/1992 | Dominka | |
| 5,709,290 | A | * | 1/1998 | Ekert et al. | 188/322.15 |
| 6,134,814 | A | | 10/2000 | Christy et al. | |
| 7,299,908 | B2 | * | 11/2007 | Achenbach | 188/322.22 |
| 2001/0032675 | A1 | * | 10/2001 | Russell | 137/493.9 |
| 2002/0038599 | A1 | | 4/2002 | Mintgen et al. | |
| 2005/0217474 | A1 | | 10/2005 | Mintgen et al. | |

FOREIGN PATENT DOCUMENTS

| | | |
|---|---|---|
| JP | 01-112040 | 4/1989 |
| JP | 04-113006 | 4/1992 |
| WO | 89/02987 | 4/1989 |
| WO | 2005/054686 | 6/2005 |

* cited by examiner

*Primary Examiner*—Thomas E Lazo
(74) *Attorney, Agent, or Firm*—Simpson & Simpson, PLLC

(57) ABSTRACT

The present invention is a hydraulic locking cylinder assembly comprising a bi-directional control relief valve integrated with a piston. More particularly, the present invention is a bi-directional control relief valve for a hydraulic cylinder, fully integrated with a piston, and having a single poppet valve that performs the function of both a direction control valve and a relief valve.

6 Claims, 7 Drawing Sheets

HYDRAULIC LOCKING CYLINDER

FIELD OF THE INVENTION

The present invention relates generally to hydraulic locking cylinders, and, more particularly, to hydraulic locking cylinders used in association with plow blades. Even more particularly, the invention relates to directional control and relief valves used in hydraulic locking cylinders.

BACKGROUND OF THE INVENTION

Hydraulic cylinders utilize pressurized hydraulic fluid to produce linear motion and force. A single action hydraulic cylinder is pressurized for motion in only one direction, either pulling in or pushing out. When a hydraulic cylinder is configured for pushing out, an external retraction spring is often used for rod return when the hydraulic pressure is removed. Single action hydraulic cylinders in combination with retraction springs are commonly used for positioning the plow blades of a typical V-type snowplow.

When employed for positioning snowplow blades, it is desirable that a single action hydraulic cylinder is capable of performing four functions: (1) extension; (2) retraction; (3) locking; and (4) relief of excess pressure when locked. Extension and retraction allow the blades of a typical V-type snowplow to be positioned back in a "V" position, forward in a "scoop" position, or in-line with each other in a "straight position".

Extension is effected by the continued application of hydraulic fluid pressure to the interior of the hydraulic cylinder, usually through a fluid port at one end of the cylinder. The mounting fluid pressure translates into linear motion as the piston, and the rod to which it is coupled, is pushed by the fluid pressure along the axis of the cylinder, such that the rod is forced out from the cylinder. Accordingly, a plow blade, to which the rod is connected, is pushed forward. Retraction is effected by the combination of the opening of the fluid port and the force of the retraction spring pulling the blade back. Once the blade is set in a desired position, the fluid port is closed, thereby holding constant the volume of hydraulic fluid in the cylinder. The external force of a retraction spring causes the hydraulic cylinder to be "locked" in position. As the plow blade pushes snow forward, the fixed volume of fluid in the pressurized cylinder resists the force of the snow mass pushing against it.

As the piston moves in the cylinder during extension and retraction, the volume of fluid behind the piston (V1) and the annular volume of fluid surrounding the rod on the opposite axial side of the piston (V2) change. During extension, V1 increases while V2 decreases. During retraction, V1 decreases while V2 increases. To accommodate the fluid volume changes, hydraulic cylinders are commonly configured in a hydraulic circuit, and utilize one or more direction control valves to route the fluid accordingly. Without such means for routing the fluid in or out of each area of the hydraulic cylinder, the fluid volumes would remain fixed, and the cylinder would remain locked in position, unable to extend or retract.

Locking a single action hydraulic cylinder is desirable in some situations. When a plow blade pushes a mass, such as snow, forward, it is crucial that the hydraulic cylinder resist the force of the mass and not retract. As stated above, the closure of the hydraulic port provides a fixed volume of hydraulic fluid, through which the piston cannot travel. However, when the dragging a snow mass backwards with the back of a plow blade, also known as "back-blading", only the force of the retraction spring is present to prevent the plow blades from being pulled forward by the mass, which often is insufficient, and the snow load is lost. It is, therefore, desirable to include a means for locking the cylinder while back-blading.

When the cylinder is locked, an excessive pressure spike on the cylinder may result in a hydraulic line/seal rupture and damage to other pressure vessels and equipment. If the cylinder is capable of locking while back-blading, an excessive pressure spike may occur, for example, if a blade hits an obstruction such as a curb or an irregularity in the ground surface. Commonly, relief valves are used to release excessive pressure. These valves control or limit the pressure in a system by allowing the pressure source fluid to flow from an auxiliary passage, away from the main flow path. A relief valve is designed to open at a predetermined pressure to protect pressure vessels and other equipment from being subjected to pressures that exceed their design limits. When the pressure setting is exceeded, the relief valve becomes the "path of least resistance" as the valve is forced open and a portion of the fluid is diverted through the auxiliary route. In the event of excessive pressure while back-blading, a relief valve would allow the cylinder to become unlocked and extend, thereby allowing the obstructed blade to be pushed forward in response to the force of the obstruction.

Direction control valves are designed to open under normal operating fluid pressures for extension and retraction. Relief valves are designed to open in response to excessive pressure, such as the excessive pressure spike described above. As such, the fluid pressure required to open a direction control valve in a hydraulic cylinder is significantly lower than the fluid pressure required to open a relief valve in the same cylinder. U.S. Pat. No. 6,134,814 (Christy) teaches, in one embodiment, a hydraulic locking cylinder capable of extension, retraction, locking, and relief of excessive pressure. The Christy cylinder includes a valve assembly coupled to the piston comprising a check valve, which is a type of direction control valve that allows flow in only one direction, coupled to a pilot assisted relief valve. By including a direction control valve and a relief valve in the valve assembly, the valve assembly is capable of performing the direction control and relief functions, as well as the cylinder locking function desired for back-blading.

The Christy valve assembly requires complex machining and the assembly of separate valves and other cartridge components. As such, the Christy valve assembly has a greater likelihood of failure than a valve comprised of fewer and simpler components, due to the greater margin of error that exists in the manufacture and assembly of a greater number of components. Valves utilized in hydraulic cylinders are often exposed to repeated stress. A valve assembly comprised of fewer and simpler components would likely have a longer life and cost less to manufacture:

Therefore, there is a longfelt need for a hydraulic cylinder valve that is capable of performing the functions of a direction control valve and a relief valve, has fewer components, fewer failure modes, a durable structure, and is as easy to install, yet less expensive to manufacture, than the Christy invention.

SUMMARY OF THE INVENTION

The present invention broadly comprises a hydraulic locking cylinder assembly having a bi-directional control relief valve fully integrated with a piston. The present invention further comprises a bi-directional control relief valve for a hydraulic locking cylinder fully integrated with a cylinder piston, wherein the valve comprises a single poppet valve capable of performing the functions of a direction control valve and a relief valve.

One object of the subject invention is to provide a bi-directional control relief valve for a hydraulic cylinder that is inexpensive to manufacture and assemble.

A second object of the invention is to provide a bi-directional control relief valve for a hydraulic cylinder that is durable.

A third object of the invention is to provide a bi-directional control relief valve for a hydraulic cylinder with few failure modes.

Another object of the invention is to provide a bi-directional control relief valve for a hydraulic cylinder that is fully integrated with the cylinder piston.

A further object of the invention is to provide a bi-directional control relief valve for a hydraulic cylinder having a single differential area poppet valve which performs all required functions.

A further object of the invention is to provide a bi-directional control relief valve for a hydraulic cylinder having a design that is scalable and modifiable for many applications A further object of the invention is to provide a bi-directional control relief valve for a hydraulic cylinder that may be easily integrated with existing hydraulic cylinders.

These and other objects and features of the present invention will become readily apparent upon reading the following detailed description in view of the drawings.

BRIEF DESCRIPTION OF THE SEVERAL VIEWS OF THE DRAWINGS

The nature and mode of the operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical structural elements of the invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims. For example, although a preferred embodiment of the invention relates to a locking hydraulic cylinder operatively arranged for use in a snow plow blade, it should be appreciated that the locking cylinder of the invention has numerous other applications unrelated to snow plows.

Figure 1:
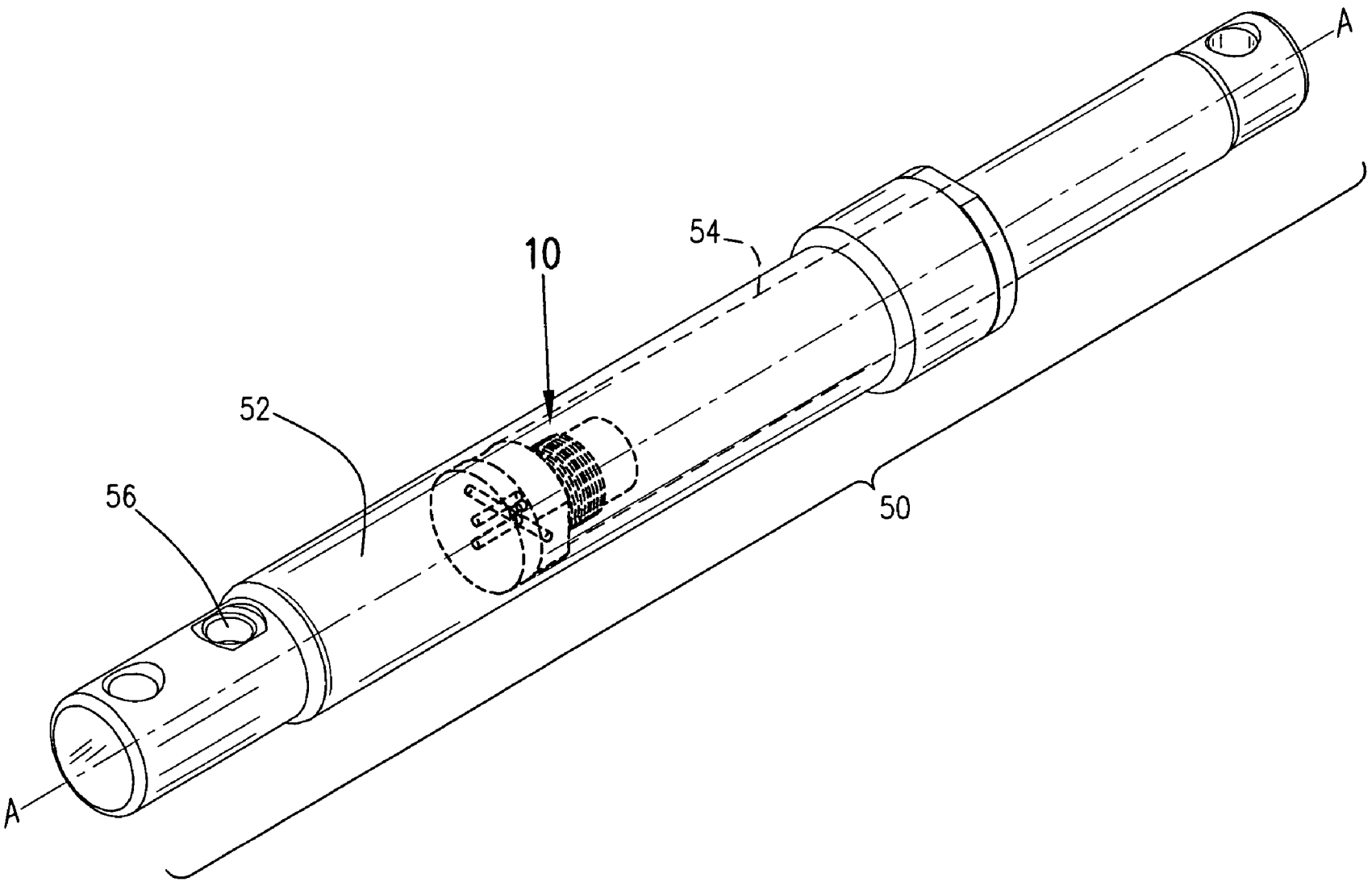
FIG. 1 is a perspective view of a hydraulic cylinder assembly having a bi-directional control relief valve integrated with the piston.

Adverting to the drawings, FIG. 1 shows a perspective view of hydraulic cylinder assembly 50 having bi-directional control relief valve 10, which is coupled to piston 12, and is disposed movably along central axis A-A of tubular cylinder 52. Fluid port 56 provides the entrance for hydraulic fluid (not shown) into cylinder 52.

Figure 2:
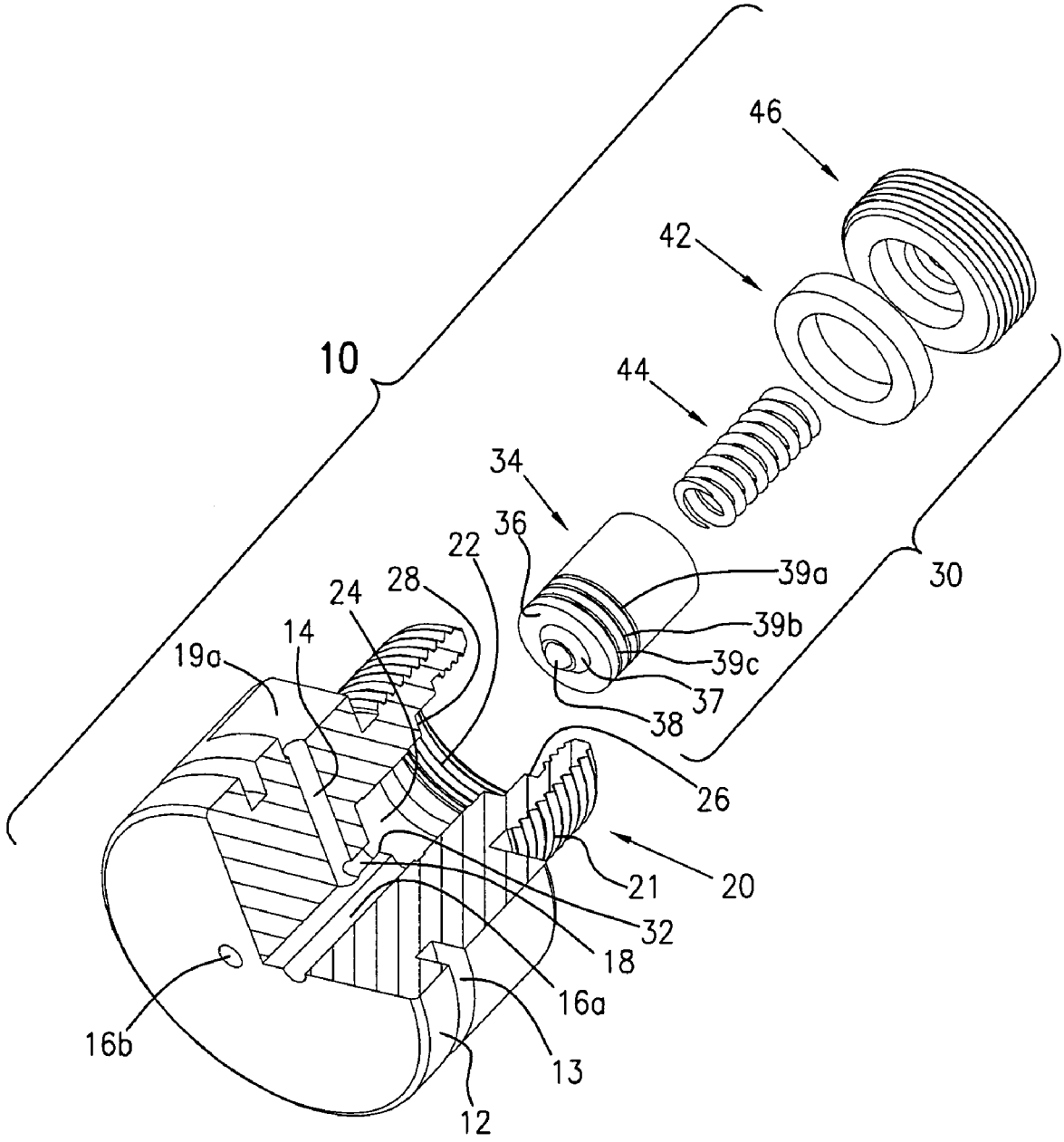
FIG. 2 is an exploded quarter-sectional view of the bi-directional control relief valve from a first angle.
Figure 3:
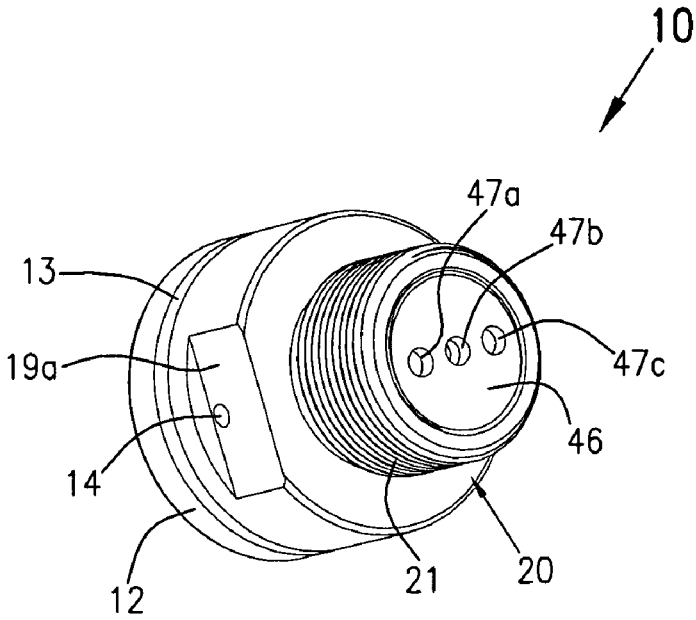
FIG. 3 is a perspective view of the bi-directional control relief valve.
Figure 4:
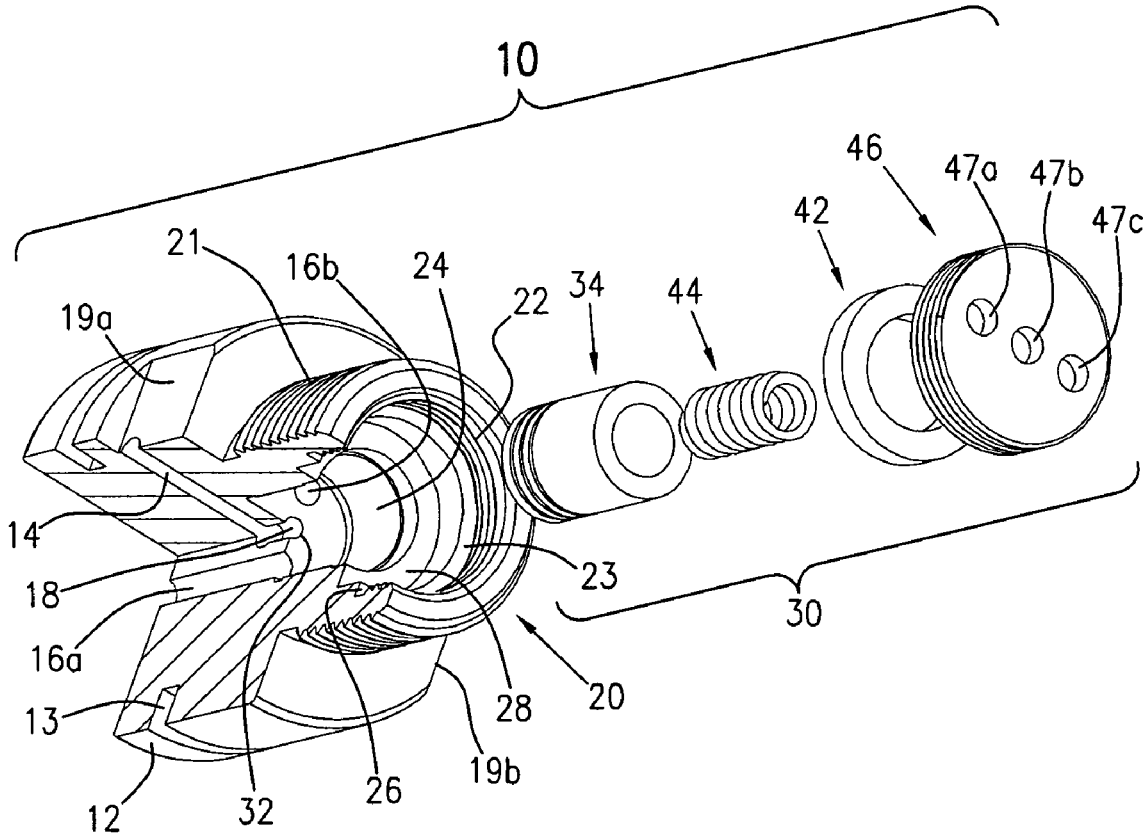
FIG. 4 is an exploded quarter-sectional view of the bi-directional control relief valve from a second angle.

FIG. 2 shows an exploded quarter-sectional view of bi-directional control relief valve 10 fully integrated with piston base 12. Both bi-directional control relief valve 10 and piston base 12 share the same central axis A-A as cylinder 52. Piston base 12 has annular groove 13 about its circumference, which is used to secure an O-ring-loaded Teflon cap seal (not shown) which provides a complete, slidable seal between piston base 12 and the inner wall of cylinder 52. Extending axially from piston base 12 is boss 20, having open end 23 (see FIG. 4). Boss 20 defines valve chamber 24, which extends axially from open end 23 toward piston base 12. External threads 21 of boss 20 are used for attaching bi-directional control relief valve 10 to rod 54. Threaded boss 20 is designed so that it may be easily integrated with the rods and cylinders of existing hydraulic cylinder assemblies. Internal threads 22 of boss 20 are used for securing threaded bonnet 46 of poppet valve 30. Piston base 12 defines radial channel 14, which extends from axial planar surface 19*a* to axial planar surface 19*b*. Piston base 12 further defines shunt 18, which is in communication with radial channel 14. Shunt 18 extends perpendicularly from channel 14 along the central axis of the piston base 12 and terminates in valve chamber 24. Shunt 18 defines valve seat 32 where it terminates in valve chamber 24. Piston base 12 further defines axially disposed through-bores 16*a* and 16*b*, both of which terminate at one end in chamber 24, and at the other end in bore 53 of cylinder 52 (see FIGS. 6 and 8). Radial channel 14, shunt 18, and through-bores 16*a* and 16*b* are fluid passages.

Poppet valve 30 comprises threaded bonnet 46, elastomeric lip seal 42, spring 44, and poppet operator 34. Poppet operator 34 is tubular with a closed end which comprises a first operable surface 36 and a second operable surface 38. In the embodiment shown in FIG. 2, first operable surface 36 further comprises frusto-conical rise 37. Second operable surface, in the same embodiment, comprises ball seal 38. Poppet operator 34 is disposed movably along the axis of in valve chamber 24 such that first operable surface 36 and second operable surface 38 are facing the terminal ends of through-bores 16*a* and 16*b*, and shunt 18, respectively. Lip seal 42 abuts annular lip seal shoulder 28, defined by boss 20, and is circumferentially disposed around a section of poppet operator 34. Spring 44 is operably disposed inside poppet operator 34. Threaded bonnet 46 engages internal threads 22 of boss 20 and abuts annular bonnet shoulder 26, defined by boss 20, effectively sealing the poppet valve 30 inside boss 20 and piston base 12. Annular grooves 39*a-c* about the circumference of operator 34 serve to maintain the proper position of poppet operator 34 in chamber 24.

Figure 5:
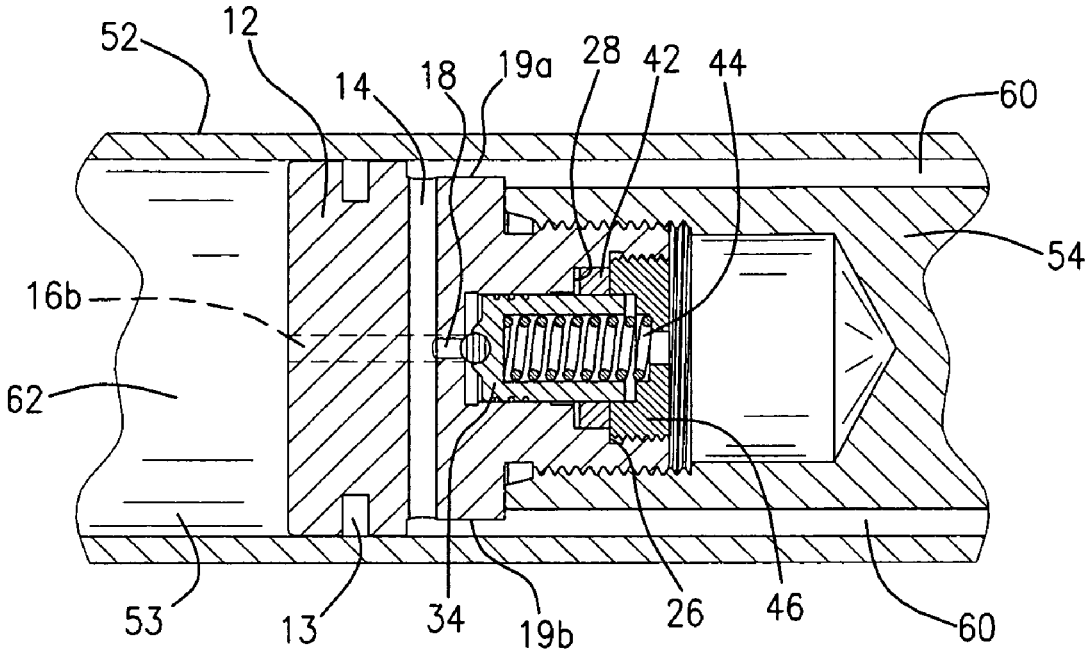
FIG. 5 is a partial cross-sectional view of the hydraulic cylinder assembly along a first axis, showing the bi-directional control relief valve in a closed position.
Figure 6:
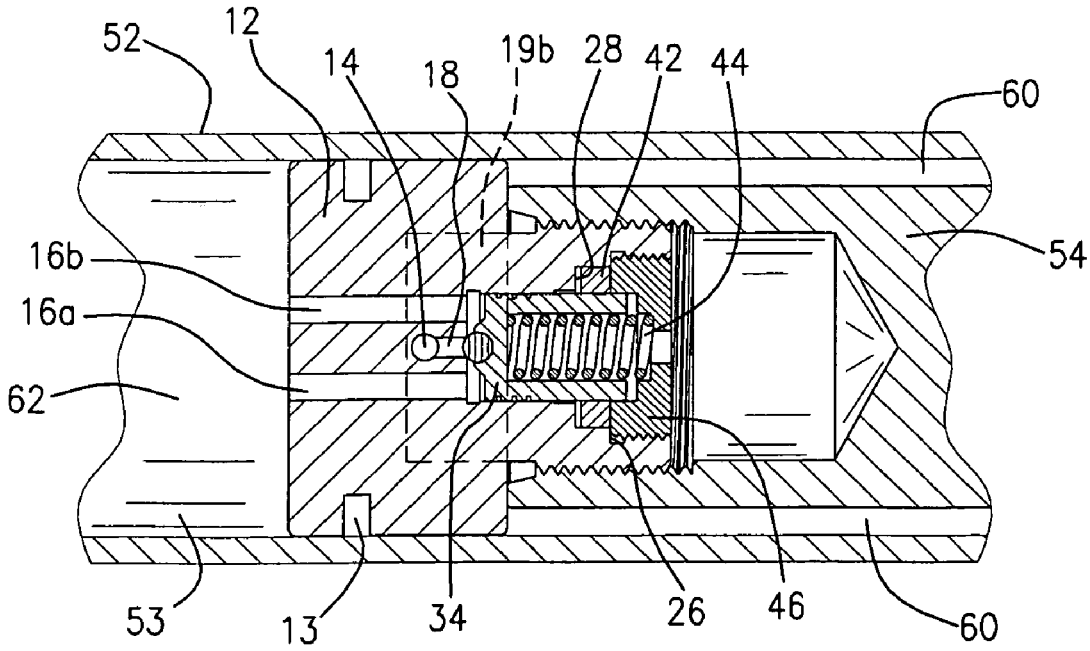
FIG. 6 is a partial cross-sectional view of the hydraulic cylinder assembly along a second axis, showing the bi-directional control relief valve in the closed position.

FIGS. 5 and 6 show the poppet valve in the closed position. When valve 30 is in the closed position, ball seal 38 sealingly engages valve seat 32. Spring 44 provides an axially directed force against bonnet 46 and poppet operator 34 to maintain the closed position. It is further contemplated that a combination of spring force and compressed gas may be utilized to provide the force necessary to maintain the closed position.

FIG. 5 shows a partial cross-sectional view of bi-directional control relief valve 10 operably disposed within hydraulic cylinder assembly 50. The axis at which hydraulic cylinder assembly 50 is cross-sected in FIG. 5, reveals radially disposed channel 14, extending from planar surface 19*a* to planar surface 19*b* of piston base 12, and shunt 18 extending from channel 14 to valve chamber 24. Channel 14 and shunt 18 allow hydraulic fluid from fluid volume 60 to reach the second operable surface, ball seal 38, of poppet operator 34. Fluid volume 60 comprises the hydraulic fluid surrounding rod 54 within bore 53 of cylinder 52, as well as the hydraulic fluid in channel 14 and shunt 18.

FIG. 6 shows a partial cross-sectional view of bi-directional control relief valve 10 operably disposed in hydraulic cylinder assembly 50. The axis at which hydraulic cylinder assembly 50 is cross-sected in FIG. 6, reveals shunt 18 and axially disposed through-bores 16*a* and 16*b*. Through-bores 16*a* and 16*b* allow hydraulic fluid from fluid volume 62 to reach valve chamber 24, further defined by first operable surface 36, frusto-conical rise, and a portion of second operable surface, ball seal 38. Fluid volume 62 comprises the hydraulic fluid in bore 53 of cylinder 52 that extends from hydraulic fluid port 56 to piston base 12, as well as the hydraulic fluid in through-bores 16*a* and 16*b* and in valve chamber 24. When poppet valve 30 is in the closed position, the connection of ball seal 38 to valve seat 32 effectively seals fluid volume 60 from fluid volume 62.

Figure 7:
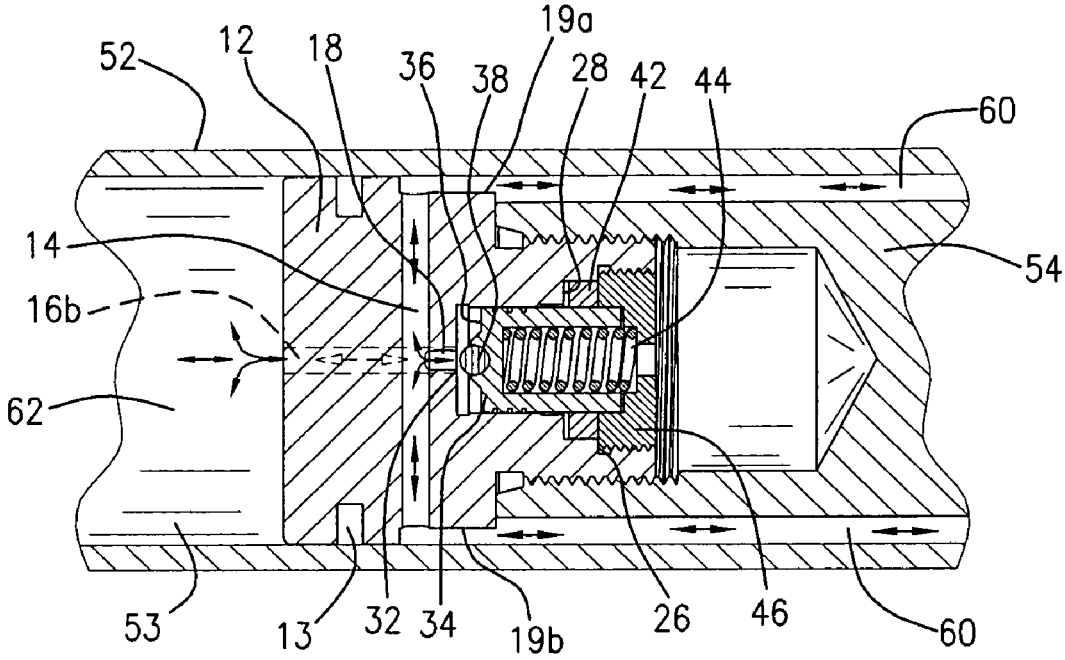
FIG. 7 is a partial cross-sectional view of the hydraulic cylinder assembly along a first axis, showing the bi-directional control relief valve in an open position.
Figure 8:
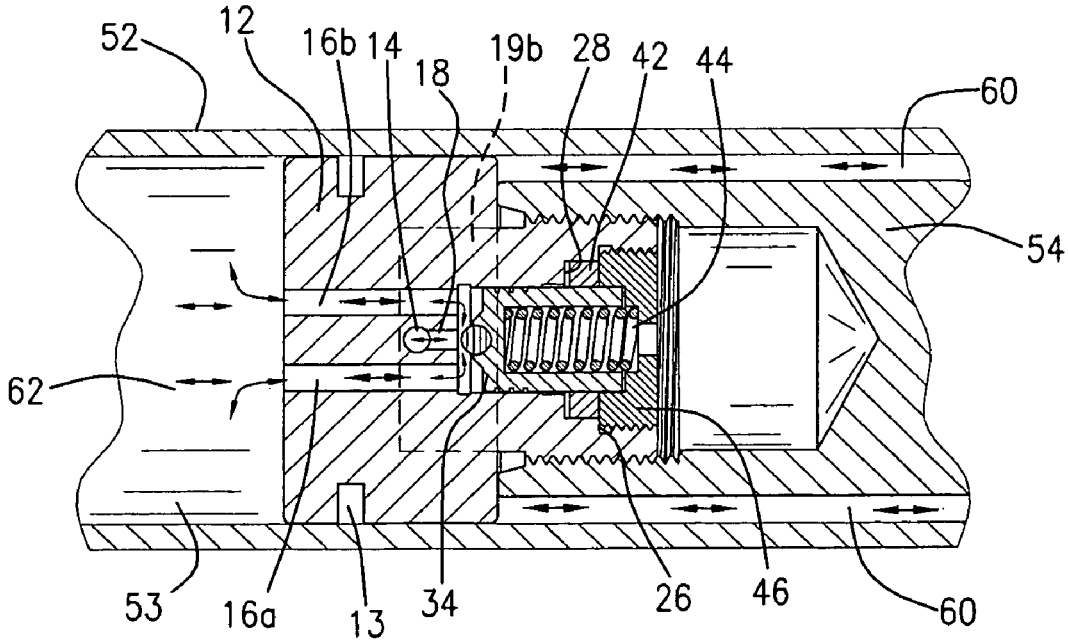
FIG. 8 is a partial cross-sectional view of the hydraulic cylinder assembly along a second axis, showing the bi-directional control relief valve in the open position.

FIGS. 7 and 8 show the same partial cross-sectional views of FIGS. 5 and 6, respectively, but with poppet valve 30 in the open position. To extend hydraulic cylinder assembly 50, hydraulic pressure is applied to fluid volume 62 from hydraulic fluid port 56. Poppet valve 30 is designed such that when the fluid pressure of fluid volume 62 acting on first operable surface 36 reaches a specific point, the force of spring 44 maintaining poppet valve 30 in the closed position will be overcome, and poppet operator 34 will move away from valve seat 32, thereby opening the poppet valve 30. Once poppet valve 30 is open, hydraulic fluid from fluid volume 60 may pass through bi-directional control relief valve 10 to become part of fluid volume 62. Therefore, fluid volume 62 increases while fluid volume 60 decreases as the hydraulic cylinder assembly 50 extends.

To retract hydraulic cylinder assembly 50, hydraulic fluid port 56 is opened. The force of retraction spring 84*a* or 84*b* (see FIGS. 9-11) on fluid volume 62 helps to maintain a back pressure in fluid volume 62 and maintain poppet valve 30 in the open position, which allows fluid from fluid volume 62 to pass through bi-directional control relief valve 10 and become part of fluid volume 60. Were the valve in a closed position, fluid exchange would not occur, and the force of retraction spring 84*a* or 84*b* on piston 12 would draw a vacuum in chamber surrounding the rod. With bi-directional control relief valve 10 in the open position, fluid volume 60 increases while fluid volume 62 decreases as the hydraulic cylinder assembly 50 retracts. The double arrows in FIGS. 7 and 8 represent the flow of hydraulic fluid in both directions, during extension and retraction, when poppet valve 30 is open. As can be appreciated from the description of the extension and retraction of hydraulic cylinder assembly 50, bi-directional control relief valve 10 serves the function of a bi-directional control relief valve for hydraulic cylinder assembly 50.

Once the cylinder extends or retracts to the desired position, the hydraulic fluid port 56 is closed, and the hydraulic pressure within assembly 50 is held constant. When the hydraulic pressure is held constant, poppet valve 30 remains open, due, in part, to the force of retraction spring 84*a* or 84*b* on fluid volume 62. Despite valve 30 being in the open position, piston 12 and rod 54 are unable to move in the direction of fluid volume 62. During back-blading, when the opposing force of the snow load on the back of the plow blades counteracts the force of retraction spring 84*a* or 84*b*, the fluid pressure of fluid volume 62 decreases, and poppet valve 30 closes, sealing off fluid volume 60 from fluid volume 62. Once valve 30 closes, the cylinder is locked, that is, the opposing force of the snow mass, if greater than the force of retraction spring 84*a* or 84*b*, will not pull rod 54 out of cylinder 52, because fluid exchange is prevent by closed valve 30. However, in the event of an excessive pressure spike while back-blading, the excessive pressure, which is acting on fluid volume 60, will open poppet valve 30 by acting on second operable surface 38. Once open, hydraulic cylinder assembly 50 becomes unlocked, and can extend as fluid from fluid volume 60 can pass through valve 30 to become part of fluid volume 62. Poppet valve 30 is configured such that the amount of fluid pressure acting on the surface area of ball seal 38 required to overcome the force of spring 44 is less than the amount of fluid pressure that would cause damage to the system. This configuration provides the relief valve function of bi-directional control relief valve 10.

As stated above, relief valves are used to release excessive pressure in the event of a potentially damaging pressure spike, and are designed to open only in such an event. Directional control valves are normally designed to open, for example, under the force of hydraulic pressure during normal operation, such as, during extension and retraction. Poppet valve 30 is configured to differentially respond to the hydraulic pressure of normal operation and to excessive pressure spikes. The differential response is based on the areal difference between first operable surface 36 and second operable surface 38 of poppet operator 34. The fluid pressure required to move poppet operator 34 is directly related to the size of the surface area of the poppet operator to which the fluid pressure is applied.

The fluid pressure of fluid volume 62 is directed axially through through-bores 16*a* and 16*b*, and acts on first operable surface 36. Conversely, the fluid pressure of fluid volume 60 is directed first radially, through channel 14, and then axially, through shunt 18, and acts on second operable surface, ball seal 38. Because first operable surface 36 has a larger area than second operable surface 38, less fluid pressure is required from fluid volume 62 to open poppet valve 30 than from fluid volume 60. Thus, by configuring poppet operator 34 to have at least two operable surfaces having dissimilar areas and acted upon by fluid volumes on opposite axial sides of piston 12, the single differential area poppet valve 30 performs all required functions, direction control and relief.

Figure 9:
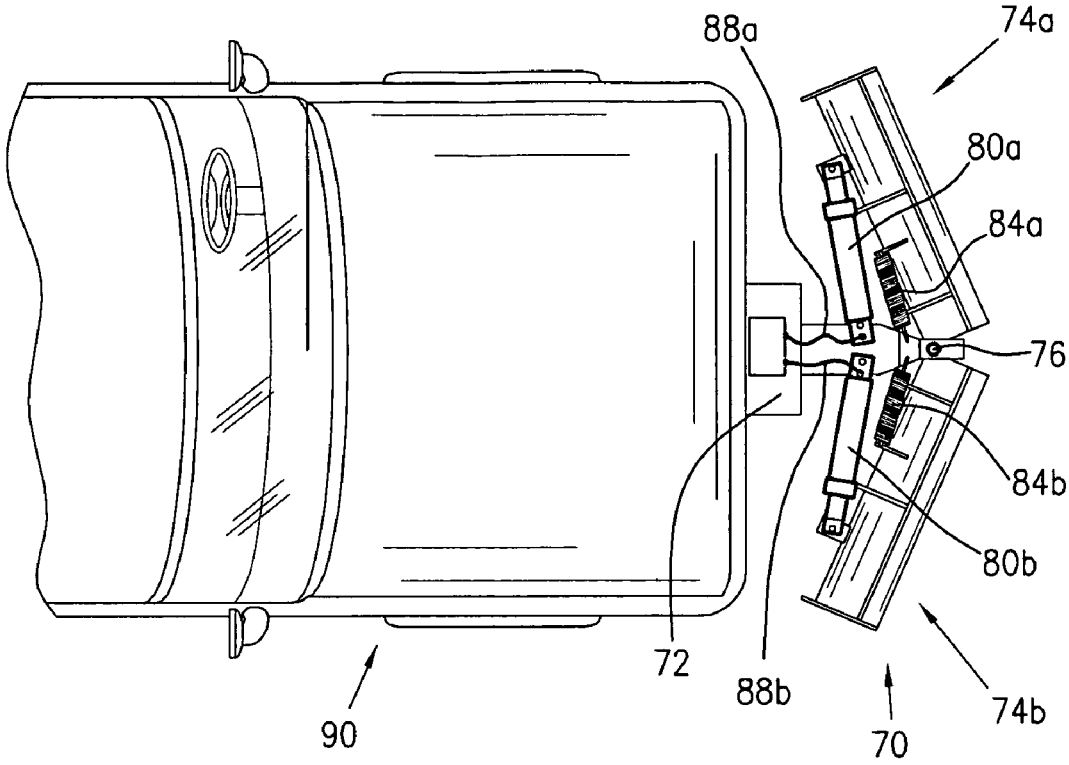
FIG. 9 is a plan view of a vehicle having a mounted plow assembly with plow blades positioned back in a "V' position.
Figure 10:
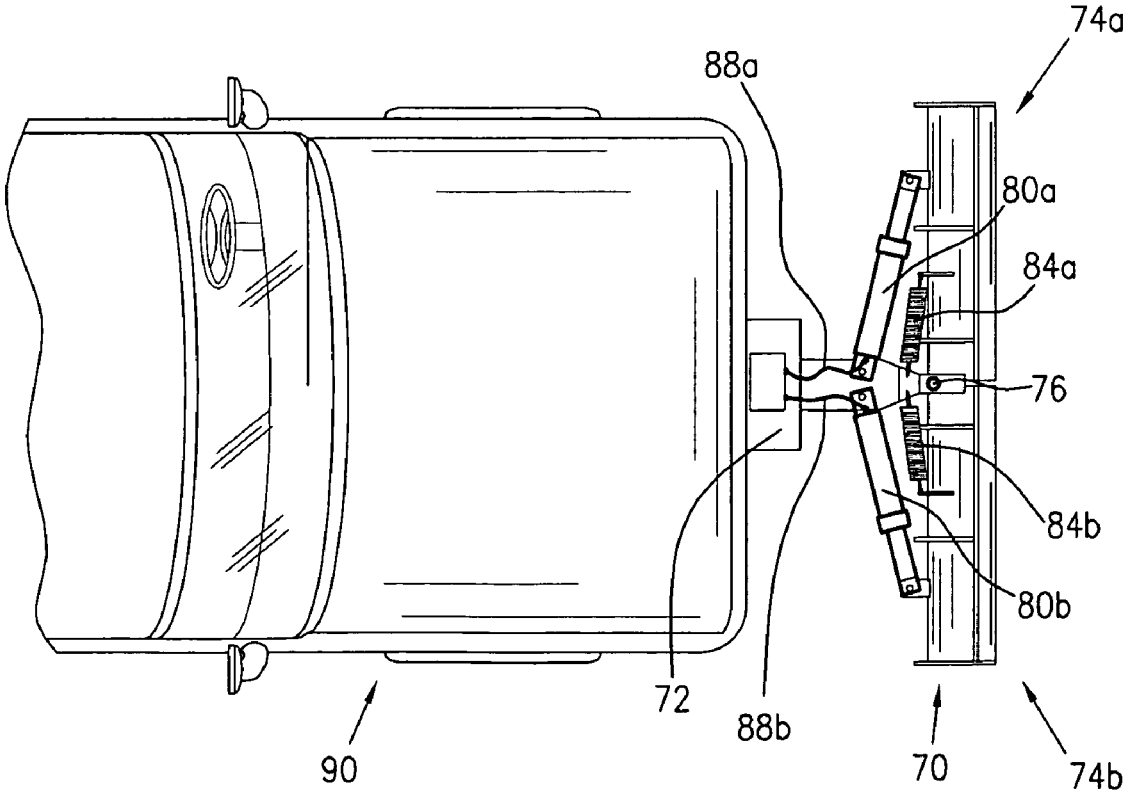
FIG. 10 is a plan view of the vehicle having a mounted plow assembly with the plow blades positioned in a "straight" position; and, FIG. 11 is a plan view of the vehicle having a mounted plow assembly with the plow blades positioned forward in a "scoop" position.
Figure 11:
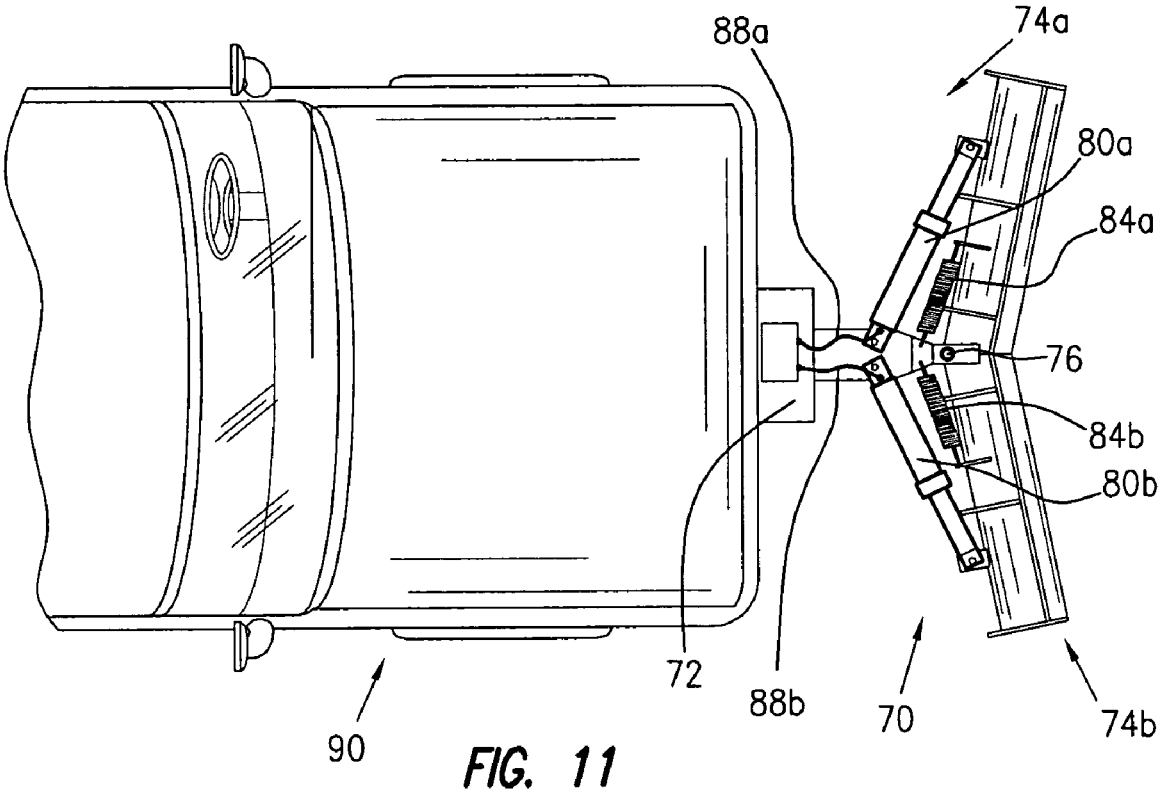

FIGS. 9-11 show snow plow assembly 70 mounted on vehicle 90. Frame 72 is mountably attached to the front end of vehicle 90. Plow blades 74*a* and 74*b* are pivotably attached to frame 72 at pivot point 76. Single action hydraulic cylinders 80*a* and 80*b* are each connected to frame 72 at a first end, and connected to plow blades 74*a* and 74*b* at a second end, respectively. Hydraulic cylinders 80*a* and 80*b* each comprise bi-directional control relief valve 10 (see FIG. 1). Hydraulic lines 88*a* and 88*b* provide hydraulic fluid from a hydraulic fluid source (not shown) to hydraulic cylinders 80*a* and 80*b*, respectively. Retraction springs 84*a* and 84*b* are each connected to frame 72 at a first end, and connected to plow blades 74*a* and 74*b* at a second end, respectively. FIG. 9 shows plow blades 74*a* and 74*b* positioned back in a "V" position. FIG. 10 shows the plow blades in-line with each other in a "straight position". FIG. 11 shows the plow blades positioned forward in a "scoop" position.

An advantage of the design of bi-directional control relief valve 10 is that it is scalable. By adjusting the various determinants, such as, the areal differential of the first and second operable surfaces, the force of the spring, the size, number, and direction of channels and through-bores, the subject invention may be used in many applications. It is further contemplated that poppet operator 34 have more than two operable surfaces. It is further contemplated that poppet operator 34 have a conical operable end, wherein the first and second operable surfaces are defined by the extent to which the apex of the cone extends past the valve seat. It is further contemplated that boss 20 need not be threaded, but may be supplied with any means known in the art for attaching piston base 20 to a hydraulic cylinder rod.

Thus it is seen that the objects of the invention are efficiently obtained, although changes and modifications to the invention should be readily apparent to those having ordinary skill in the art, which changes would not depart from the spirit and scope of the invention as claimed.

What I claim is:

1. A bi-directional control relief valve for a hydraulic cylinder comprising:

a piston base having at least a first and second fluid passage and a central axis having a first and a second axial end; and, a single poppet valve operably integrated with the piston base, wherein the poppet valve is actuated through the first fluid passage from the first axial end, and wherein the poppet valve is actuated through the second fluid passage from the second axial end;

wherein said first fluid passage comprises a pair of through-bores extending axially from said first axial end of said piston base to a chamber formed by said single poppet valve and said piston base.

2. A hydraulic locking cylinder assembly comprising:

a tubular member having a central axis and an inner wall;

a rod disposed slidably within the tubular member along the central axis;

a cylindrical piston having a first and second axial end and at least a first and second fluid passage, wherein the outer circumference of the piston sealingly and slidingly engages the inner wall of tubular member, the piston being coupled to the rod on the first axial end;

hydraulic fluid disposed within the tubular member on the first and second axial ends of the piston; and, a poppet valve operably integrated with the piston, wherein the poppet valve is actuated by the hydraulic fluid through the first fluid passage from the first axial end of the tubular member, and wherein the poppet valve is actuated by the hydraulic fluid through the second fluid passage from the second axial end of the tubular member;

wherein said first fluid passage of said cylindrical piston comprises a pair of through-bores extending axially from said first axial end of said cylindrical piston to a chamber formed by said single poppet valve and said piston base.

3. The hydraulic locking cylinder assembly of claim 2, wherein the poppet valve comprises a first and second operable surface, wherein the hydraulic fluid from the first axial end of the tubular member actuates the poppet valve by means of a first fluid pressure acting on the first operable surface, and wherein the hydraulic fluid from the second axial end of the tubular member actuates the poppet valve by means of a second fluid pressure operating on the second operable surface.

4. The hydraulic locking cylinder of claim 3, wherein the area of the first operable surface is unequal to the area of the second operable surface.

5. The hydraulic locking cylinder of claim 4, wherein the first operable surface is an annular surface, and wherein the second operable surface is a spherical surface.

6. The hydraulic locking cylinder of claim 4, wherein the first operable surface is a conical surface, and wherein the second operable surface is a frusto-conical surface.

* * * * *